US008468923B2

(12) United States Patent
Patel et al.

(10) Patent No.: US 8,468,923 B2
(45) Date of Patent: Jun. 25, 2013

(54) APPARATUS AND METHOD FOR SELECTIVELY AFFECTING A LAUNCH TRAJECTORY OF A PROJECTILE

(75) Inventors: Umang R. Patel, Mansfield, TX (US); Wayne K. Schroeder, Mansfield, TX (US); Johnny E. Banks, Venus, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 686 days.

(21) Appl. No.: 11/676,209

(22) Filed: Feb. 16, 2007

(65) Prior Publication Data

US 2010/0269677 A1 Oct. 28, 2010

(51) Int. Cl.
*F41F 7/00* (2006.01)

(52) U.S. Cl.
USPC ..... 89/1.819

(58) Field of Classification Search
USPC ..... 89/1.819, 1.8, 1.802, 1.816, 1.817, 89/1.81, 1.809, 1.818
See application file for complete search history.

(56) References Cited

U.S. PATENT DOCUMENTS

| | | | | |
|---|---|---|---|---|
| 4,185,538 | A * | 1/1980 | Barakauskas | 89/1.81 |
| 4,584,925 | A * | 4/1986 | Culotta et al. | 89/1.807 |
| 5,012,718 | A * | 5/1991 | Miller | 89/1.816 |
| 6,752,060 | B1 * | 6/2004 | Griffin | 89/1.817 |

FOREIGN PATENT DOCUMENTS

| | | |
|---|---|---|
| GB | 2374398 | 10/2002 |
| JP | 2000213894 | 8/2000 |

* cited by examiner

*Primary Examiner* — Bret Hayes
*Assistant Examiner* — Reginald Tillman, Jr.
(74) *Attorney, Agent, or Firm* — Slater & Matsil, L.L.P.

(57) ABSTRACT

An apparatus for selectively affecting a launch trajectory of a projectile from a canister includes means for selectively positioning the projectile with respect to the canister and a sabot operably associated with the projectile and the means for selectively positioning the projectile. A projectile launch system includes a canister, a projectile disposed in the canister, and means for selectively positioning the projectile with respect to the canister. A method for affecting a launch trajectory of a projectile includes providing a canister and a projectile disposed in the canister and adjusting a position of the projectile with respect to the canister.

26 Claims, 8 Drawing Sheets

103
105
903
908
907
901
10
10
909
905c
905a
905b
CONTROLLER

APPARATUS AND METHOD FOR SELECTIVELY AFFECTING A LAUNCH TRAJECTORY OF A PROJECTILE

BACKGROUND

1. Field of the Invention

The present invention relates to an apparatus and method for selectively affecting a launch trajectory of a projectile.

2. Description of Related Art

Projectiles, such as missiles, rockets, and the like, are used in combat situations to destroy or disable enemy targets. It is desirable, if not necessary, for such a projectile to be suitably aimed toward a target prior to launch for optimum effectiveness. Conventional aiming mechanisms position the projectile and the launch canister in which the projectile is housed prior to launch into an direction suitable to reach and strike the intended target. If, after a target has been identified, the projectile is already aimed generally in a suitable direction to strike the target, the projectile can be launched quickly. If, however, the projectile is not suitably aimed toward the target, the launch canister must be repositioned, thus delaying the projectile launch, as aerodynamically-controlled projectiles lack sufficient controllability to perform a rapid turn.

Such a delay can prove disastrous in some combat situations, especially when the projectile is used as a defensive munition against an incoming, moving target. The problem is magnified when defending an area from attacks that may come from many directions. The number of projectile launchers required to defend the area depends, at least in part, upon the slew rate of the projectile launcher aiming mechanisms. The slew rate is the distance the aiming mechanism can move the projectile in a given period of time. Lower slew rates are undesirable, as the extra time taken to direct or aim the projectile critically increases the overall time to respond to a threat. Larger response times result in greater numbers of projectile launchers being required to defend the area.

This problem is further magnified by projectile launch systems that include multiple projectiles and launch canisters that are grouped into a fixed set. In such configurations, simultaneous projectile launches, whether in the same direction or in different directions, may not be possible.

It is desirable for almost any combat equipment to be as lightweight and inexpensive as possible. Aiming mechanisms capable of faster slew rates, however, are heavier and more expensive than mechanisms capable of slower slew rates. Moreover, the weight, size, cost, and volume of canister aiming mechanisms grow dramatically with increasing slew rate. Furthermore, the weight, size, cost and volume of canister aiming mechanisms grow dramatically with increasing launch event forces and moments.

It is also desirable for the missile to have the largest effective range possible. The range is determined by its terminal velocity at this range. An aerodynamically controlled missile launched in a conventional manner expends a large amount of energy in a turn to achieve its desired flight path. The energy expended in the turn lowers the potential range of the interceptor.

There are many designs of projectile aiming mechanisms well known in the art, however, considerable shortcomings remain.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, wherein:

Figure 1:
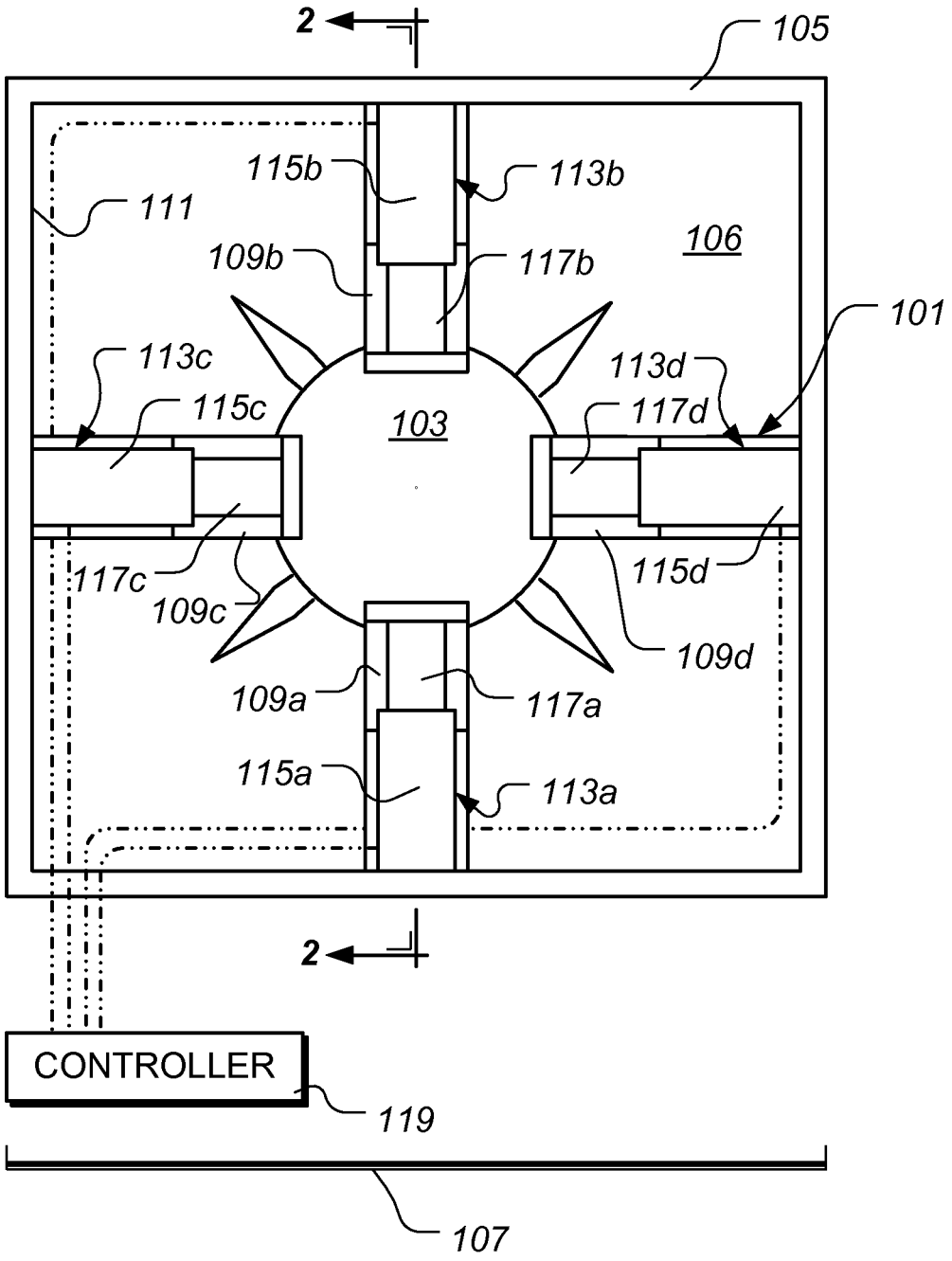
FIG. 1 is a stylized, end, elevational view of a first illustrative embodiment of a projectile launch system.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The invention represents an apparatus and a method for affecting the launch trajectory of a projectile. Generally, the apparatus includes a means for affecting a trajectory of the projectile without adjusting a position of a canister in which the projectile is housed prior to launch. The apparatus imparts an angular acceleration, an angular momentum, an angular velocity, and/or a net angle change to the projectile, irrespective of the launch canister's position, to direct the flight of the projectile during launch. In one embodiment, the apparatus includes a mechanism that interacts with the projectile to adjust the spatial orientation of the projectile as the projectile is launched from the canister. In another embodiment, the apparatus includes a mechanism that adjusts the spatial orientation of the projectile with respect to the canister prior to projectile launch.

Figure 2:
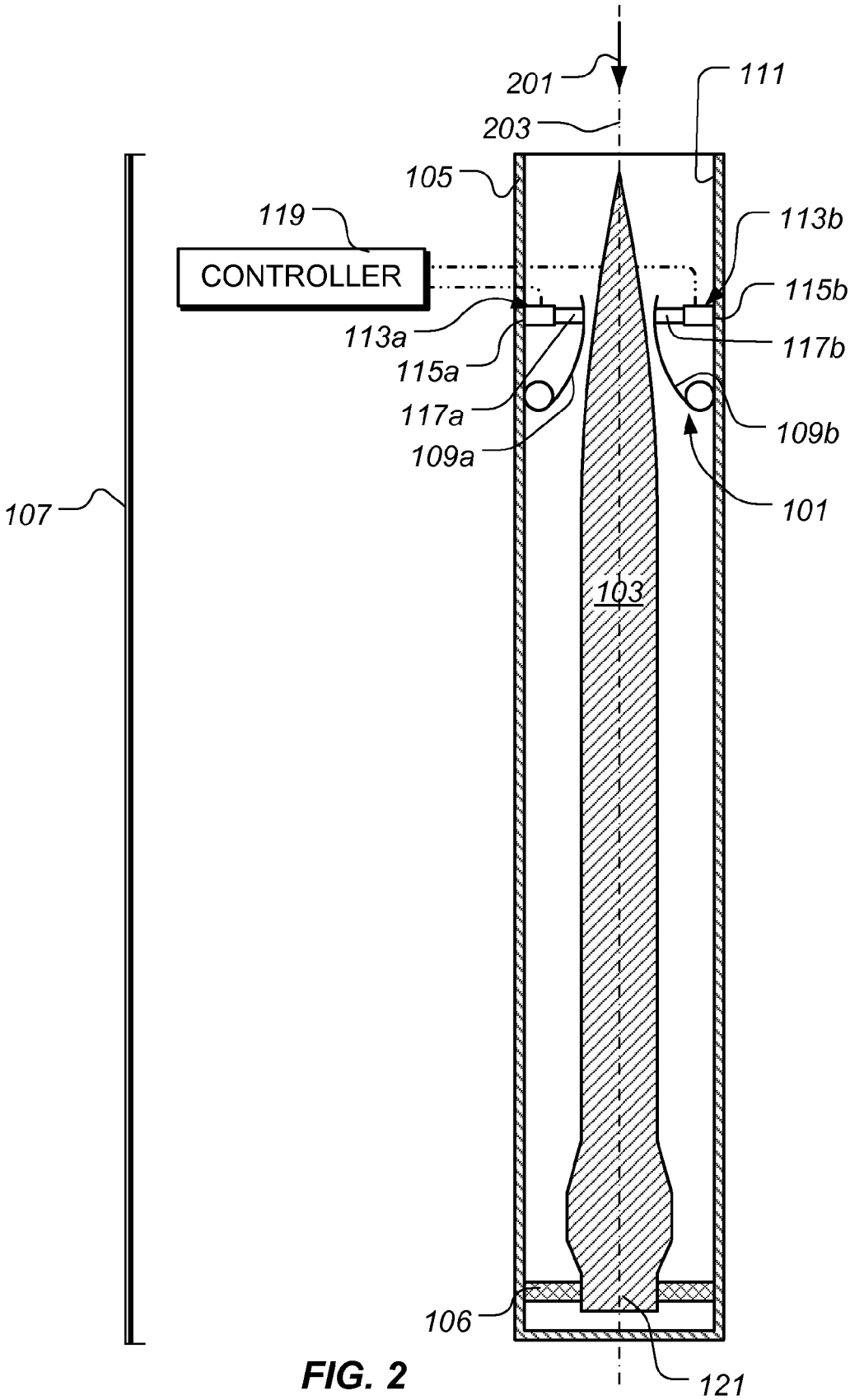
FIG. 2 is a stylized, cross-sectional view of the projectile launch system of FIG. 1, taken along the line 2-2 in FIG. 1.

FIGS. 1 and 2 depict a first illustrative embodiment of an apparatus 101 according to the present invention for directing a projectile 103 launched from a canister 105. A passive sabot 106 extends between projectile 103 and canister 105. FIG. 1 is a stylized, end, elevational view of apparatus 101, projectile 103, canister 105, and passive sabot 106 looking in a direction indicated by an arrow 201 in FIG. 2. FIG. 2 is a stylized, partial cross-sectional view taken along the line 2-2 in FIG. 1. Note that projectile 103, canister 105, and passive sabot 106 are depicted in cross-section in FIG. 2 but apparatus 101 is not depicted in cross section in FIG. 2. It should also be noted that internal elements of projectile 103 are not illustrated in FIG. 2, as projectile 103 may take on many different forms. Moreover, passive sabot 106 may be replaced by passive sabot 703, shown in FIG. 7.

Apparatus 101, in combination with projectile 103, canister 105, and passive sabot 106 form a projectile launch system 107. It should be noted that the specific configurations of projectile 103, canister 105, and passive sabot 106 depicted in FIGS. 1 and 2 are merely exemplary. Apparatus 101 may be utilized with many different configurations of projectiles and canisters. Accordingly, apparatus 101, in combination with any suitable projectile and canister, forms a projectile launch system according to the present invention. It should also be noted that apparatus 101, by way of example and illustration, is but one means for selectively positioning a projectile (e.g., projectile 103 or the like) with respect to the projectile's canister (e.g., canister 105 or the like) to affect a launch trajectory of the projectile.

Still referring to FIGS. 1 and 2, apparatus 101 comprises a plurality of sabots 109*a*-109*d* mechanically coupled with an inner wall 111 of canister 105. Each of the plurality of sabots 109*a*-109*d* is operably associated with one of a corresponding plurality of force devices 113*a*-113*d* and mechanically coupled with inner wall 111 of canister 105. While four sabots 109*a*-109*d* and four force devices 113*a*-113*d* are depicted in FIG. 1, the scope of the present invention encompasses any suitable number of sabots (e.g., sabots 109*a*-109*d* or the like) and force devices (e.g., force devices 113*a*-113*d* or the like). In one embodiment, for example, apparatus 101 comprises three sabots and three force devices but may comprise one or more sabots and one or more force devices.

In the illustrated embodiment, each of the plurality of force devices 113*a*-113*d* comprises an actuator 115*a*-115*d* and a piston 117*a*-117*d* slidingly extending from the corresponding actuator 115*a*-115*d*. Each of the plurality of force devices 113*a*-113*d* is controlled by a controller 119 to exhibit desired reaction forces to sabots 109*a*-109*d*, respectively. In other words, controller 119 individually controls the amounts of force required to urge each of the plurality of pistons 117*a*-117*d* into the corresponding actuators 115*a*-115*d*. It should be noted that any of the plurality of actuators may comprise electromagnetic motors, hydraulic actuators, pneumatic actuators, piezoelectric actuators, gas generant actuators, or the like. The scope of the present invention encompasses any actuator 115*a*-115*d* of a type suitable for providing a selectable reaction force to projectile 103, as will be discussed in greater detail below. It should also be noted that the plurality of sabots 109*a*-109*d* and the corresponding plurality of force devices 113*a*-113*d* are preferably disposed evenly about projectile 103.

Figure 3:
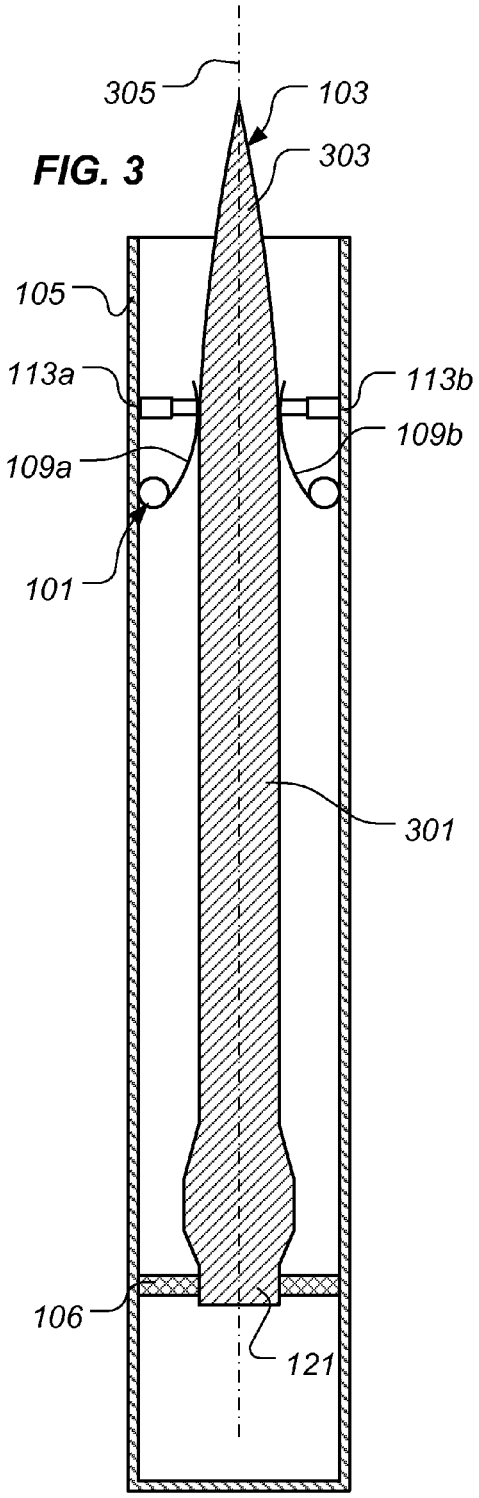
FIGS. 3 and 4 are stylized, cross-sectional views, corresponding to the view of FIG. 2, of the projectile launch system of FIG. 1, illustrating two particular modes of operation of the projectile launch system.

Referring now to FIG. 3, projectile 103 interacts with each of the plurality of force devices 113*a*-113*d* through the plurality of sabots 109*a*-109*d*. Specifically, a body 301 of projectile 103 contacts each of the plurality of sabots 109*a*-109*d* as projectile 103 is launched from canister 105. In the illustrated embodiment, the plurality of sabots 109*a*-109*d* first contacts body 301 of projectile 103 proximate a nose 303 of projectile 103. If controller 119 sets each of the plurality of force devices 113*a*-113*d* to exhibit the same reaction force (i.e., each piston 117*a*-117*d* of the plurality of force devices 113*a*-113*d* requires the same force to be urged into the corresponding actuator 115*a*-115*d*), projectile 103 follows a trajectory from canister 105 based upon propulsive and aerodynamic forces acting on projectile 103. If, however, the controller 119 sets at least one of the plurality of force devices 113*a*-113*d* to exhibit a force that is different from one or more of the other force devices 113*a*-113*d*, the trajectory of projectile 103 is altered from the trajectory driven by the aerodynamic forces acting on projectile 103.

For example, as depicted in FIG. 3, controller 119 sets each of the plurality of force devices 113*a*-113*d* to exhibit substantially the same reaction force. Note that force devices 113*c* and 113*d* are not shown in FIG. 3 but are depicted in FIG. 1. Projectile 103 encounters and interacts with each of the plurality of force devices 113*a*-113*d* via the plurality of sabots 109*a*-109*d* as projectile 103 is launched. Because each of the plurality of force devices 113*a*-113*d* exhibits substantially the same reaction force, projectile 103 is launched along an undeflected trajectory, represented by an axis 305.

Figure 4:
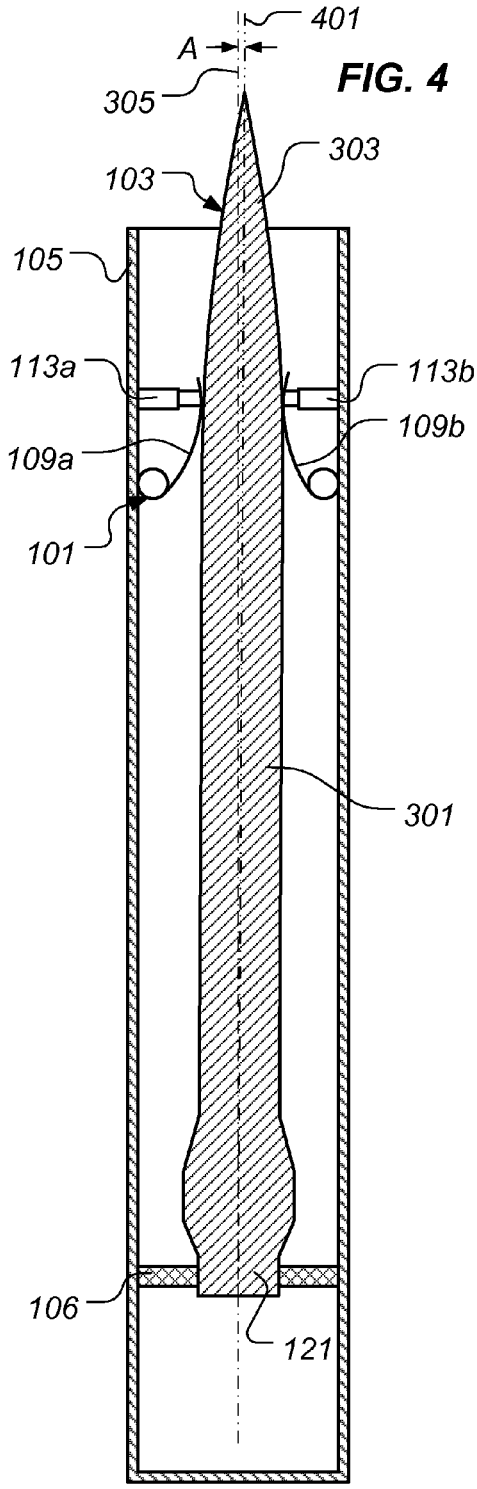

As shown in FIG. 4, however, controller 119 sets force device 113*b* to exhibit a reaction force that is less than a reaction force exhibited by force device 113*a*. Projectile 103 encounters and interacts with each of the plurality of force devices 113*a*-113*d* via the plurality of sabots 109*a*-109*d* as projectile 103 is launched. Because force device 113*b* exhibits a reaction force that is less than a reaction force exhibited by force device 113*a*, projectile 103 is steered along a deflected trajectory, represented by an axis 401. Thus, the launch trajectory of projectile 103 is changed by angle A, from the undeflected trajectory along axis 305 to the deflected trajectory along axis 401. Controller 119 is operable to individually set the reaction forces exhibited by force devices 113*a*-113*d* based upon the desired launch trajectory of projectile 103. It should be noted that controller 119 may be a separate component or may be incorporated into a launch control system (not shown) of projectile launch system 107. The one or more force devices (e.g., force devices 113*a*-113*d* or the like) are, by way of example and illustration, one particular means for positioning projectile 103.

It should be noted that an aft end 121 of projectile 103 travels substantially along a central axis 203 of canister 105 as projectile 103 is launched from canister 105. Thus, a moment or torque is imparted to projectile 103 about aft end 121 of projectile 103, which affects the launch trajectory of projectile 103 and, therefore, directs the flight of projectile 103 during launch. The position of aft end 121 with respect to canister 105 is maintained by passive sabot 106. Passive sabot 106 also captures propulsion gases between projectile 103, canister 105, and passive sabot 106. Such propulsion gases may be produced, for example, by a motor (not shown) of projectile 103 or other means for propelling projectile 103 from canister 105.

Figure 5:
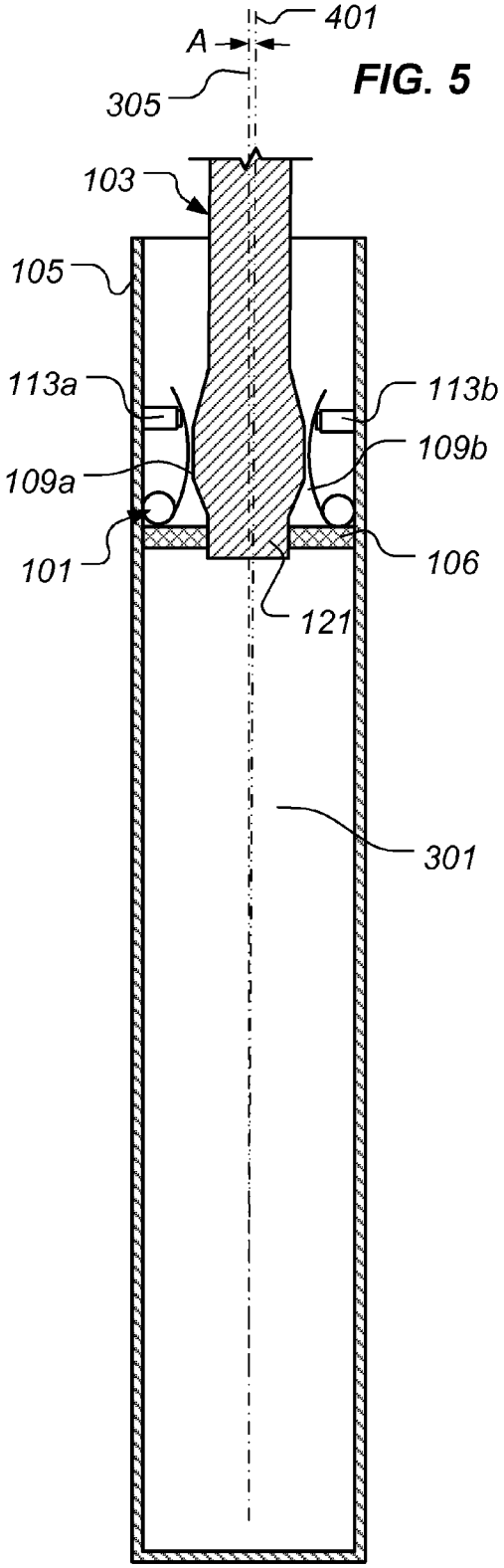
FIG. 5 is a stylized, cross-sectional view, corresponding to the view of FIG. 2, of the projectile launch system of FIG. 1, illustrating one particular embodiment of a means for retaining a passive sabot within a canister of the launch system.
Figure 6:
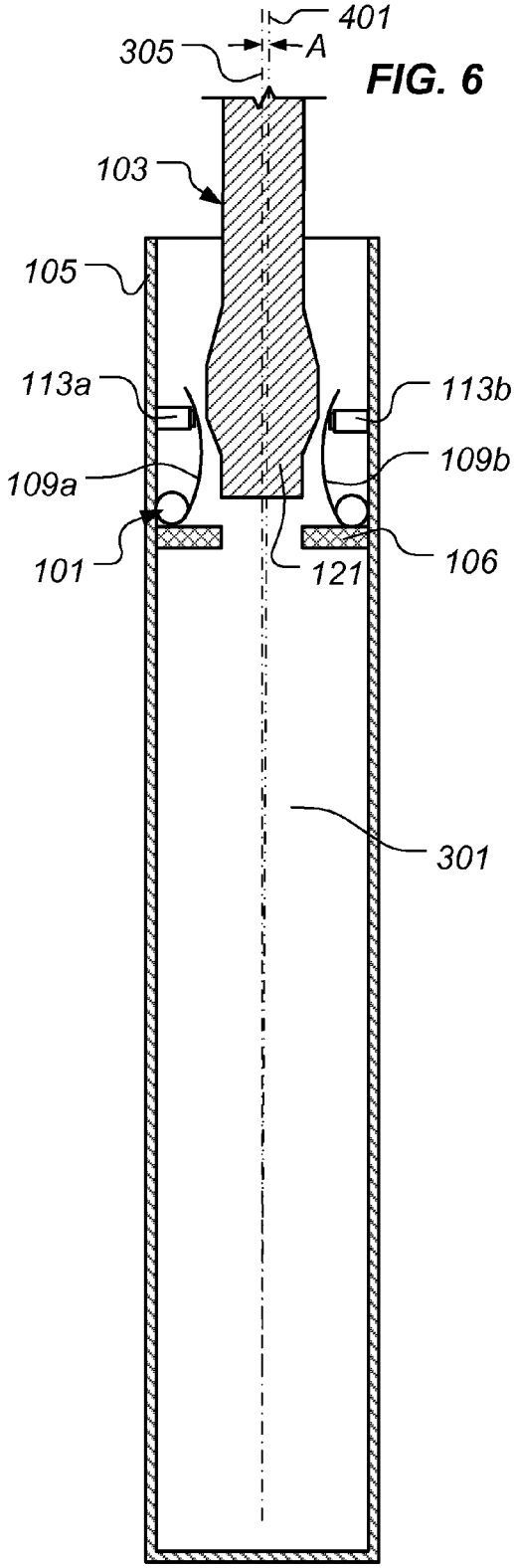
FIG. 6 is a stylized, cross-sectional view, corresponding to the view of FIG. 2, of the projectile launch system of FIG. 1, illustrating one particular mode of operation of an apparatus for affecting the launch trajectory of a projectile of the launch system.

FIGS. 5 and 6 depict projectile 103 exiting canister 105. Referring particularly to FIG. 5, apparatus 101 is compliant as aft end 121 of projectile 103 passes sabots 109*a*-109*d*, as it is preferable for aft end 121 to remain substantially on central axis 203 of canister 105. Alternatively, apparatus 101 may retract force devices 113*a*-113*d* immediately prior to aft end 121 reaching apparatus 101, so that apparatus 101 imparts substantially no forces to projectile 103 at, about, or near aft end 121 of projectile 103.

Referring now to FIG. 6, passive sabot 106 is preferably retained within canister 105 to limit the dispersion of debris outside canister 105. In the illustrated embodiment, passive sabot 106 is retained within canister 105 by apparatus 101, for example, by one or more of sabots 109*a*-109*d*. Thus, by way of example and illustration, apparatus 101 and sabots 109*a*-109*d* are but two means for retaining passive sabot 106 within canister 105.

Figure 7:
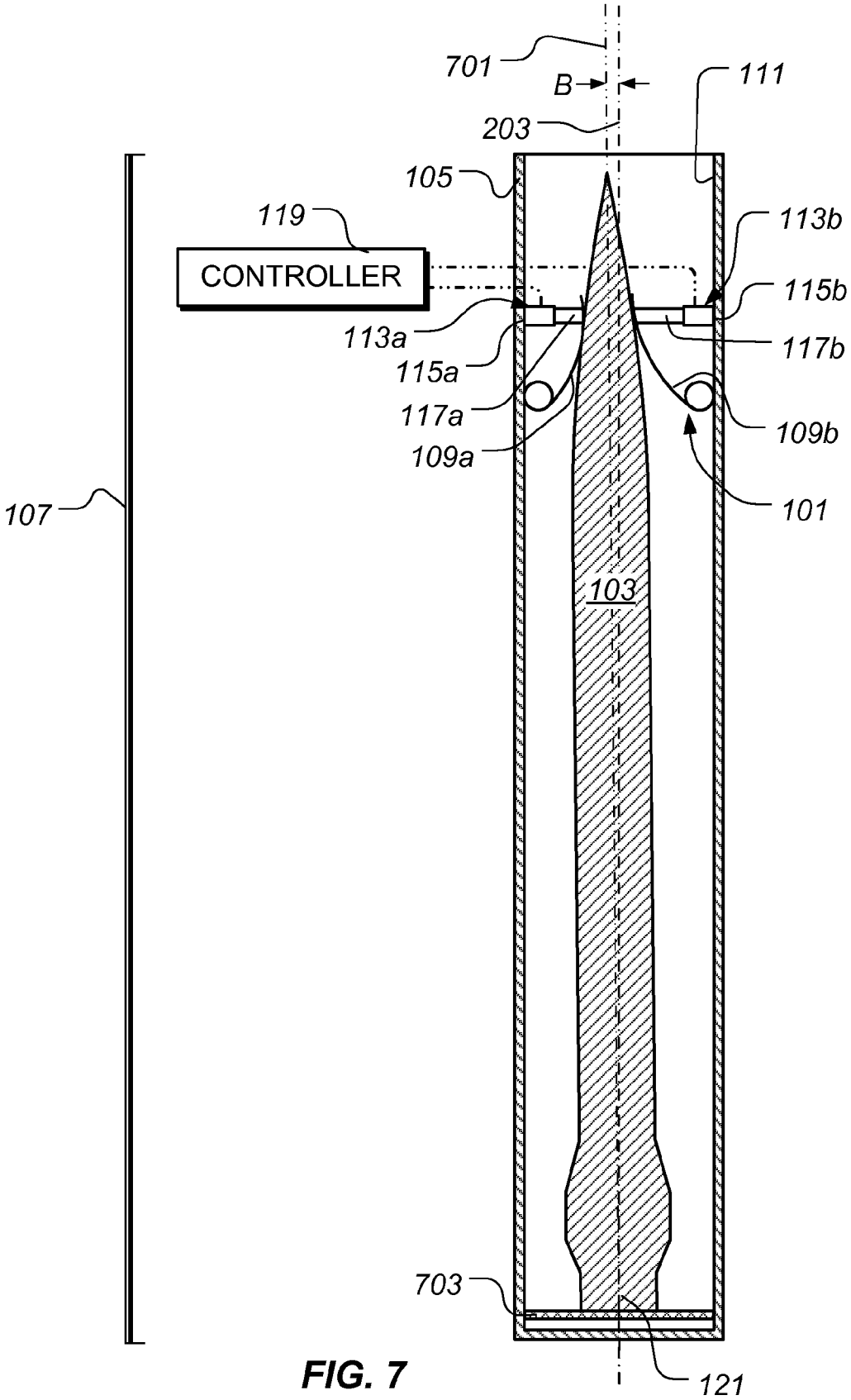
FIG. 7 is a stylized, cross-sectional view, corresponding to the view of FIG. 2, of the projectile launch system of FIG. 1, depicting another particular mode of operation the projectile launch system.

Alternatively, as shown in FIG. 7, force devices 113*a*-113*d* are selectively configured to provide a pre-launch position of projectile 103 substantially along axis 701. Note that force devices 113*c* and 113*d* are not shown in FIG. 7 but are shown in FIG. 1. Axis 701 is angularly offset from axis 203 of canister 105 by an angle B. In the illustrated embodiment, passive sabot 106 has been replaced by passive sabot 703 or "pusher plate" that is disposed aft of aft end 121 of projectile 103. The scope of the present invention, however, is not so limited, as passive sabot 106 may be used in the embodiment of FIG. 7 instead of passive sabot 703. Force devices 113*a*-113*d* are selectively controlled to produce desired reaction forces to sabots 109*a*-109*d*. These reaction forces place projectile 103 in a desired position with respect to canister 105 prior to launch.

Upon launching projectile 103, whether by a motive force produced by projectile 103 or from another source, projectile 103 interacts with force devices 113*a*-113*d*. This interaction imparts forces on one or more of force devices 113*a*-113*d* that may exceed the controlled, desired reaction forces produced by the one or more force devices 113*a*-113*d*. In such a situation, the one or more forces devices 113*a*-113*d* become compliant, allowing the forces imparted by projectile 103 on the one or more force devices 113*a*-113*d* to overcome the controlled reaction forces of force devices 113*a*-113*d*. As in the embodiment discussed herein relating to FIGS. 1-6, a moment or torque is imparted to projectile 103 about aft end 121 of projectile 103, which affects the launch trajectory of projectile 103. Thus, the flight of projectile 103 is directed during launch.

Figure 8:
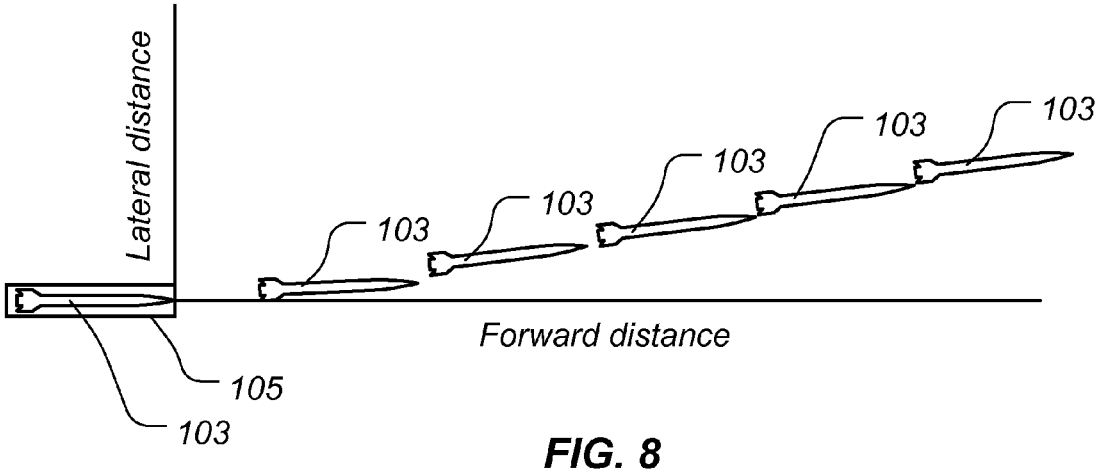
FIG. 8 is a stylized graph illustrating a computer simulated flight path of one particular operational mode of the projectile launch system of FIG. 1.

FIG. 8 depicts a computer simulated flight path of one particular operational mode of projectile launch system 107. It should be noted that the simulated flight path of FIG. 8 results from a simulation that considers both mechanical and aerodynamic body force physics. In this example, one of the plurality of force devices 113*a*-113*d* is set by controller 119 to exhibit a non-zero reaction force, while the other of the plurality of force devices 113*a*-113*d* are set to have substantially a zero reaction force, either prior to projectile 103 being launched or during the launch of projectile 103. As shown in FIG. 8, projectile 103 achieves a progressively larger lateral deflection as projectile 103 moves forward.

Figure 10:
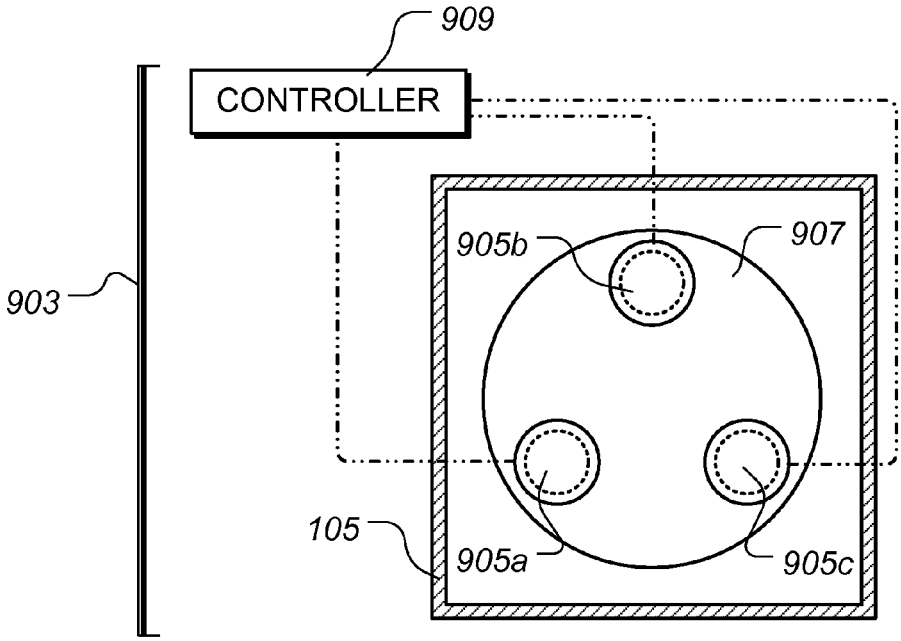
FIG. 10 is a stylized, partial cross-sectional view of the projectile launch system of FIG. 9, taken along the line 10-10 in FIG. 9.
Figure 9:
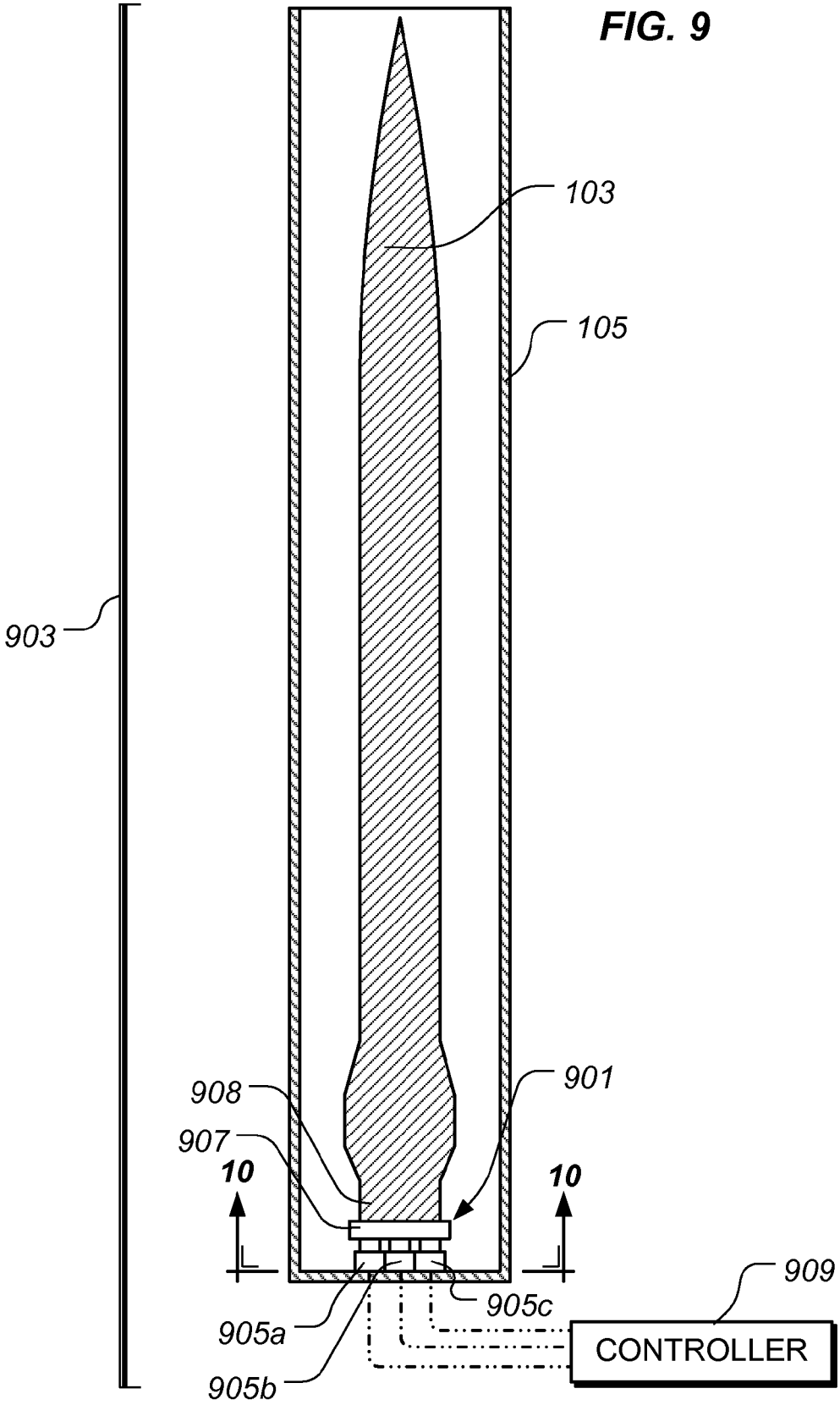
FIG. 9 is a stylized, partial cross-sectional view, corresponding to the view of FIG. 2, of a second illustrative embodiment of a projectile launch system.

FIGS. 9 and 10 depict a second illustrative embodiment of an apparatus 901 according to the present invention for directing projectile 103 launched from canister 105. FIG. 9 is a stylized, partial cross-sectional view corresponding to the view of FIG. 2. Note that, in FIG. 9, projectile 103 and canister 105 are depicted in cross-section but apparatus 901 is not so depicted. It should also be noted that internal elements of projectile 103 are not illustrated in FIG. 9, as projectile 103 may take on many different forms. FIG. 10 is stylized, partial cross-sectional view taken along the line 10-10 in FIG. 9, in which canister 105 is shown in cross-section but apparatus 901 is not so depicted.

Apparatus 901, in combination with projectile 103 and canister 105, form a projectile launch system 903 according to the present invention. As noted above with respect to the embodiment of FIGS. 1 and 2, the specific configurations of projectile 103 and canister 105 depicted in FIGS. 9 and 10 are merely exemplary. Apparatus 901 may be utilized with many different configurations of projectiles and canisters. Accordingly, apparatus 901, in combination with any suitable projectile and canister, form a projectile launch system 903 according to the present invention. It should also be noted that apparatus 901, by way of example and illustration, is but one means for positioning a projectile (e.g., projectile 103 or the like) with respect to the projectile's canister (e.g., canister 105 or the like).

Still referring to FIGS. 9 and 10, apparatus 901 comprises a plurality of actuators 905*a*-905*c* mechanically coupled with inner wall 111 of canister 105 and operably associated with a sabot 907. Sabot 907 is operably associated with projectile 103. In one embodiment, sabot 907 interfaces or mates with an exhaust nozzle at an aft end 908 of projectile 103. Sabot 907 may extend to canister 105 in a fashion similar to that of passive sabot 703. Each of the plurality of actuators 905*a*-905*c* are individually operable by a controller 909 to tilt sabot 907 and, thus, projectile 103 with respect to canister 105 prior to the launch of projectile 103 to affect a launch trajectory of projectile 103. It should be noted that the scope of the present invention encompasses any suitable number of actuators (e.g., actuators 905*a*-905*c* or the like), even though three actuators 905*a*-905*c* are illustrated in FIG. 10.

Figure 11:
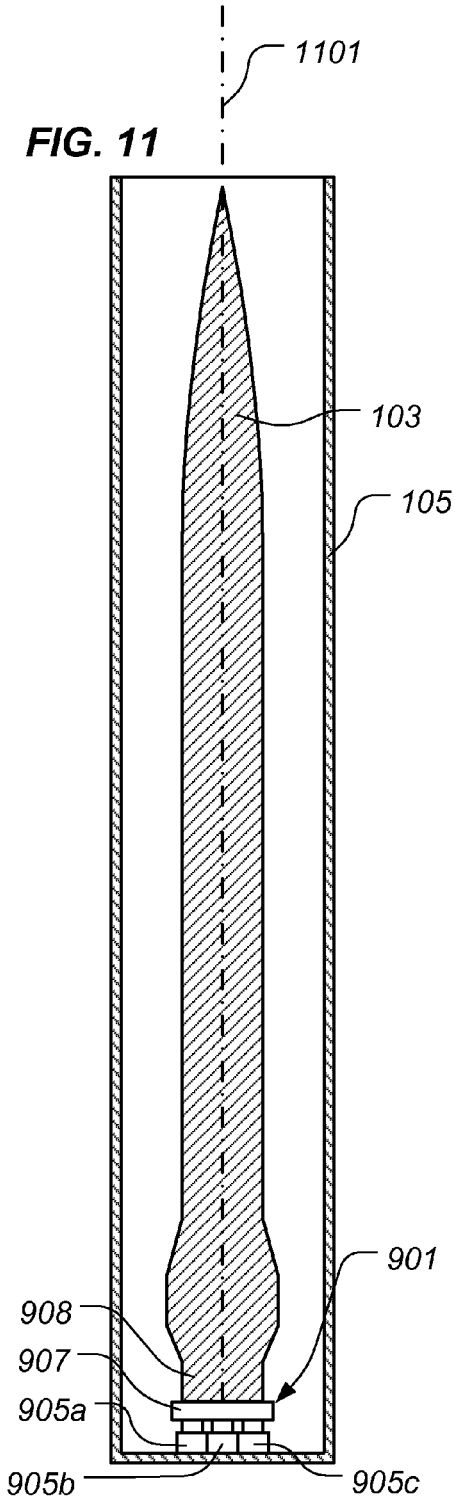
FIGS. 11 and 12 are stylized, cross-sectional views, corresponding to the view of FIG. 9, of the projectile launch system of FIG. 9, illustrating two particular modes of operation of the projectile launch system.

For example, as shown in FIG. 11, controller 909 operates the plurality of actuators 905*a*-905*c* such that projectile 103 is substantially aligned with an axis 1101, which represents an undeflected launch trajectory of projectile 103. Thus, when projectile 103 is launched from canister 105, projectile 103 travels along the undeflected trajectory, represented by axis 1101.

Figure 12:
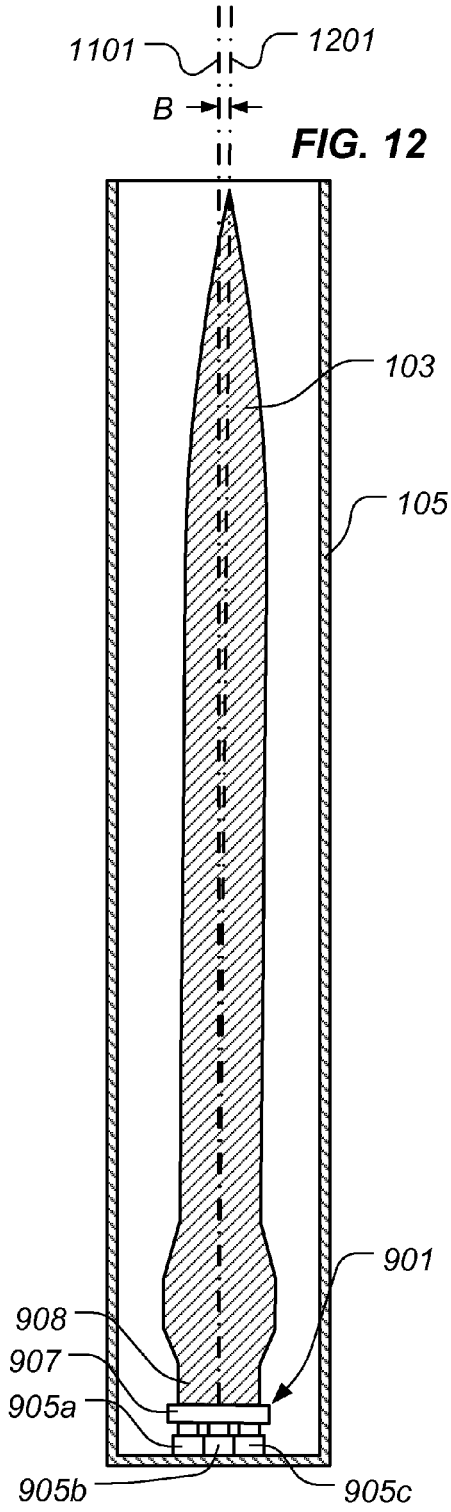

As shown in FIG. 12, however, controller 909 operates the plurality of actuators 905*a*-905*c* to tilt projectile 103 along an axis 1201, which represents a deflected launch trajectory of projectile 103. Thus, when projectile is launched from canister 105, projectile 103 travels along the deflected trajectory, represented by axis 1201. Thus, the flight of projectile 103 is directed during launch. It should be noted that controller 909 may be a separate component or may be incorporated into a launch control system (not shown) of projectile launch system 903. The one or more actuators (e.g., actuators 905*a*-905*c* or the like) are, by way of example and illustration, one particular means for positioning projectile 103.

It should be noted that in the embodiments disclosed herein, passive sabots in addition to passive sabot 106 may be used to locate projectile 103 within canister prior to launch. Sabots 109*a*-109*d* and/or sabot 807 may also be configured to locate projectile 103 within canister prior to launch.

It should also be noted that the moment or torque placed on projectile 103 results both the forces placed on projectile 103 by elements of the invention and the inertial response of projectile 103 to these forces and other launch forces on the center of gravity of projectile 103. Moreover, one or more aspects of the plurality of embodiments disclosed herein may be combined to form another embodiment of the invention.

In one aspect of the invention, an apparatus for selectively affecting a launch trajectory of a projectile from a canister is provided. The apparatus includes means for selectively positioning the projectile with respect to the canister and a sabot operably associated with the projectile and the means for selectively positioning the projectile. In another aspect, the present invention provides a projectile launch system. The projectile launch system includes a canister, a projectile disposed in the canister, and means for selectively positioning the projectile with respect to the canister. In yet another aspect, the invention provides a method for affecting a launch trajectory of a projectile. The method includes providing a canister and a projectile disposed in the canister and adjusting a position of the projectile with respect to the canister.

The present invention provides significant advantages, including: (1) providing means for affecting a launch trajectory of the projectile without adjusting a position of the canister; (2) providing a means for quickly positioning a projectile at a target; (3) providing a means for launching a plurality of projectiles at a single target without repositioning canisters housing the projectiles; (4) providing a means for launching a plurality of projectiles at a plurality of target locations without repositioning canisters housing the projectiles, and (5) providing a means for improving the effective range by reducing the energy-expensive, initial turn maneuver by the projectile.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. An apparatus for selectively affecting a launch trajectory of a projectile-from a canister having an inner wall, comprising:

a canister having an inner wall and configured to receive therein a projectile;

means, anchored from the inner wall, for selectively positioning the projectile with respect to the canister; and a sabot having a first portion connected to the inner wall and a second portion configured to be in contacting engagement with the means for selectively positioning the projectile during a launch of the projectile.

2. The apparatus, according to claim 1, wherein the means for selectively positioning the projectile comprises:

a force device operable to exhibit a reaction force to the sabot.

3. The apparatus, according to claim 2, wherein the force device comprises:

an actuator; and a piston slidingly extendable from the actuator.

4. The apparatus, according to claim 1:

wherein the sabot is one of a plurality of sabots; and wherein the means for selectively positioning the projectile includes means for applying a plurality of reaction forces to the corresponding plurality of sabots.

5. The apparatus, according to claim 4, wherein the means for applying a plurality of reaction forces to the corresponding plurality of sabots comprises:

a plurality of force devices corresponding to and operably associated with the plurality of sabots, each of the plurality of force devices individually operable to exhibit a reaction force to one of the plurality of sabots.

6. The apparatus, according to claim 5, wherein at least one of the plurality of force devices comprises:

an actuator; and a piston slidingly extendable from the actuator.

7. The apparatus, according to claim 1, wherein the means for selectively positioning the projectile comprises:

a plurality of actuators operably associated with the sabot, each of the plurality of actuators individually operable to tilt the sabot.

8. The apparatus, according to claim 1, further comprising:

a controller operable to control the means for selectively positioning the projectile.

9. The apparatus, according to claim 1, wherein the means for selectively positioning the projectile is operable to position the projectile prior to launch.

10. A projectile launch system, comprising:

a canister having an inner wall;

a projectile disposed in the canister;

means, anchored from the inner wall, for selectively positioning the projectile with respect to the canister; and a sabot operably associated with the projectile and the means for selectively positioning the projectile, the sabot configured to be in contacting engagement with both the projectile and the means for selectively positioning the project during launch of the projectile.

11. The projectile launch system, according to claim 10, wherein the means for selectively positioning the projectile comprises:

a force device operably associated with the sabot, the force device operable to exhibit a reaction force to the projectile via the sabot.

12. The projectile launch system, according to claim 11, wherein the force device comprises:

an actuator; and a piston slidingly extendable from the actuator, the piston being operably associated with the sabot.

13. The projectile launch system, according to claim 11, wherein:

the sabot is one of a plurality of sabots operably associated with the projectile and the means for selectively positioning the projectile; and the force device is one of a plurality of force devices corresponding to and operably associated with the plurality of sabots, each of the plurality of force devices individually operable to exhibit a reaction force to one of the plurality of sabots.

14. The projectile launch system, according to claim 13, wherein at least one of the plurality of force devices comprises:

an actuator; and a piston slidingly extendable from the actuator.

15. The projectile launch system, according to claim 10, wherein the means for selectively positioning the projectile comprises:

at least one actuator operably associated with at least one the sabot, the at least one actuator operable to tilt the at least one sabot.

16. The projectile launch system, according to claim 10, further comprising:

a controller for operating the means for selectively positioning the projectile.

17. The projectile launch system, according to claim 10, wherein the means for selectively positioning the projectile is operably associated with a body of the projectile.

18. The projectile launch system, according to claim 17, wherein the means for selectively positioning the projectile is operable on the body of the projectile proximate a nose of the projectile.

19. The projectile launch system, according to claim 10, wherein the means for selectively positioning the projectile is operably associated with an aft end of the projectile.

20. A method for affecting a launch trajectory of a projectile, comprising:

providing a canister having an inner wall and a projectile disposed in the canister;

adjusting a position of the projectile with respect to the canister originating from the inner wall thereof; and contacting a body of the projectile with a sabot during launch of the projectile from the canister, wherein the sabot is configured to offset the projectile from a nominal trajectory of launch when a reaction force is applied to the sabot during launch of the projectile.

21. The method, according to claim 20, wherein adjusting the position of the projectile is accomplished by applying a reaction force to the projectile via the sabot during launch of the projectile.

22. The method, according to claim 20, further comprising retaining the sabot within the canister during launch of the projectile.

23. The method, according to claim 20, wherein adjusting the position of the projectile is accomplished by tilting the sabot.

24. The method, according to claim 20, wherein contacting the body of the projectile with the sabot during launch of the projectile is accomplished by contacting the body of the projectile proximate a nose of the projectile with the sabot during launch of the projectile.

25. The method, according to claim 20, wherein adjusting the position of the projectile is accomplished prior to launching the projectile from the canister.

26. The method, according to claim 20, further comprising imparting a torque about an aft end of the projectile during launch of the projectile.

* * * * *

UNITED STATES PATENT AND TRADEMARK OFFICE

CERTIFICATE OF CORRECTION

PATENT NO. : 8,468,923 B2
APPLICATION NO. : 11/676209
DATED : June 25, 2013
INVENTOR(S) : Patel et al.

It is certified that error appears in the above-identified patent and that said Letters Patent is hereby corrected as shown below:

In he Claims

In Col. 8, line 62, Claim 15, delete “the sabot,” and insert --sabot,--.

Signed and Sealed this
Thirtieth Day of July, 2013

Teresa Stanek Rea
*Acting Director of the United States Patent and Trademark Office*